US012133587B2

(12) United States Patent
Burgess et al.

(10) Patent No.: US 12,133,587 B2
(45) **Date of Patent: *Nov. 5, 2024**

(54) GOLF BAG INCORPORATING DUAL SHOULDER STRAP ASSEMBLY

(71) Applicant: Acushnet Company, Fairhaven, MA (US)

(72) Inventors: Ian Burgess, Tiverton, RI (US); Duane Marshall, Greenwich, RI (US)

(73) Assignee: Acushnet Company, Fairhaven, MA (US)

( * ) Notice: Subject to any disclaimer, the term of this patent is extended or adjusted under 35 U.S.C. 154(b) by 48 days.

This patent is subject to a terminal disclaimer.

(21) Appl. No.: 18/150,330

(22) Filed: Jan. 5, 2023

(65) Prior Publication Data

US 2023/0144863 A1 May 11, 2023

Related U.S. Application Data

(63) Continuation of application No. 16/556,290, filed on Aug. 30, 2019, now Pat. No. 11,576,480.

(51) Int. Cl.

| | |
|---|---|
| ***A45F 3/04*** | (2006.01) |
| ***A45F 3/12*** | (2006.01) |
| ***A63B 55/00*** | (2015.01) |

(52) U.S. Cl.

CPC ..... *A45F 3/04* (2013.01); *A45F 3/12* (2013.01); *A63B 55/408* (2015.10); *A45F 2200/05* (2013.01)

(58) Field of Classification Search

CPC .... A45F 3/12; A45F 3/047; A45F 3/04; A45F 3/14; A45F 2003/142; A63B 55/408; A44B 11/12; Y10T 24/3403; A45C 13/30

USPC ..... 224/264

See application file for complete search history.

(56) References Cited

U.S. PATENT DOCUMENTS

| | | | | |
|---|---|---|---|---|
| D275,153 | S | 8/1984 | Weinreb | |
| 4,515,300 | A | 5/1985 | Cohen | |
| 4,879,768 | A | 11/1989 | McClees et al. | |
| 4,978,044 | A | 12/1990 | Silver | |
| 5,038,984 | A | 8/1991 | Izzo | |
| 5,042,703 | A | 8/1991 | Izzo | |
| 5,042,704 | A | 8/1991 | Izzo | |
| 5,319,806 | A * | 6/1994 | Hermann | A41D 13/0512 2/310 |
| 5,348,205 | A | 9/1994 | Steurer | |
| 5,419,473 | A | 6/1995 | Lamar | |
| D362,752 | S | 10/1995 | Steurer | |
| 5,558,259 | A | 9/1996 | Izzo | |

(Continued)

*Primary Examiner* — Adam J Waggenspack

(57) ABSTRACT

A golf bag comprising a body for holding golf clubs and a shoulder strap assembly comprising (i) a first shoulder strap, (ii) a second shoulder strap, (iii) a bridge member, and (iv) a plurality of connecting straps coupled to the first and second shoulder straps. The first and second shoulder straps are configured to extend laterally towards each other. The bridge member is configured to directly and undetachably couple the first and second shoulder straps. A first end of the bridge member is attached to the first shoulder strap at a first attachment point, and a second end of the bridge member is attached to the second shoulder strap at a second attachment point. The connecting straps are attached to the first shoulder strap and the second shoulder strap at a third attachment point and a fourth attachment point.

20 Claims, 9 Drawing Sheets

(56) References Cited

U.S. PATENT DOCUMENTS

| | | | | |
|---|---|---|---|---|
| 5,566,871 | A | 10/1996 | Weintraub | |
| 5,593,077 | A | 1/1997 | Izzo | |
| 5,636,778 | A | 6/1997 | Jones et al. | |
| 5,860,769 | A | 1/1999 | Seligman | |
| D409,838 | S | 5/1999 | Steurer | |
| D411,039 | S | 6/1999 | Reimers et al. | |
| D411,666 | S | 6/1999 | Reimers et al. | |
| D412,396 | S | 8/1999 | Reimers et al. | |
| 5,954,254 | A * | 9/1999 | Maeng | A63B 55/408 224/259 |
| 5,988,475 | A | 11/1999 | Han | |
| 6,006,974 | A | 12/1999 | Varney et al. | |
| 6,131,783 | A | 10/2000 | Maeng | |
| 6,152,342 | A | 11/2000 | Suk | |
| 6,152,343 | A * | 11/2000 | Shin | A45F 3/14 224/264 |
| 6,168,060 | B1 | 1/2001 | Mayers | |
| D438,705 | S | 3/2001 | Steurer | |
| 6,305,535 | B1 | 10/2001 | Fair | |
| 6,311,884 | B1 | 11/2001 | Johnson | |
| 6,457,620 | B1 | 10/2002 | Batten et al. | |
| 6,460,747 | B1 | 10/2002 | Tuerschmann et al. | |
| 6,467,661 | B1 | 10/2002 | Mistretta et al. | |
| 6,530,129 | B1 | 3/2003 | Cheng | |
| D492,107 | S | 6/2004 | Brown | |
| 6,883,691 | B2 | 4/2005 | Pratt et al. | |
| 6,915,932 | B1 | 7/2005 | Wolfe | |
| 6,926,183 | B2 | 8/2005 | Chang | |
| 7,004,363 | B2 | 2/2006 | Fenton | |
| 7,025,237 | B2 | 4/2006 | Herold | |
| D528,800 | S | 9/2006 | Liu et al. | |
| 7,131,534 | B2 | 11/2006 | Enes | |
| 7,198,183 | B2 | 4/2007 | Yang | |
| 7,387,226 | B2 | 6/2008 | Porter | |
| 8,186,549 | B2 | 5/2012 | Campbell et al. | |
| 8,322,585 | B2 | 12/2012 | Herron et al. | |
| 8,657,168 | B2 | 2/2014 | Wear et al. | |
| D707,448 | S | 6/2014 | Enes | |
| D707,450 | S | 6/2014 | Enes | |
| 8,833,622 | B2 | 9/2014 | Campbell et al. | |
| D758,078 | S | 6/2016 | Enes | |
| 9,877,570 | B2 | 1/2018 | Bergkvist | |
| 9,924,780 | B2 | 3/2018 | Park | |
| 10,188,918 | B2 | 1/2019 | Howard et al. | |
| D848,733 | S | 5/2019 | Dahl | |
| 2001/0003344 | A1 | 6/2001 | Jarman | |
| 2002/0088836 | A1 | 7/2002 | Batten et al. | |
| 2003/0075464 | A1 | 4/2003 | Shin | |
| 2003/0121942 | A1 | 6/2003 | Chang | |
| 2004/0144820 | A1 | 7/2004 | Herold | |
| 2004/0238385 | A1 | 12/2004 | Herold | |
| 2005/0145517 | A1 | 7/2005 | Yang | |
| 2005/0173481 | A1 | 8/2005 | La Greca | |
| 2007/0175940 | A1 | 8/2007 | Sacks | |
| 2007/0262105 | A1 | 11/2007 | Tan | |
| 2008/0164165 | A1 | 7/2008 | McGuire et al. | |
| 2012/0241341 | A1 | 9/2012 | Harris | |

* cited by examiner

GOLF BAG INCORPORATING DUAL SHOULDER STRAP ASSEMBLY

CROSS-REFERENCE

This application is a Continuation of co-pending and co-assigned U.S. patent application Ser. No. 16/556,290 filed on Aug. 30, 2019, the disclosure of which is incorporated herein by reference in its entirety for all purposes.

FIELD OF THE INVENTION

The present invention generally relates to golf bags having a dual shoulder strap assembly wherein a first strap is fitted over one shoulder and a second strap is fitted over the other shoulder in order to desirably distribute the weight of the bag amongst both shoulders of a person carrying the bag.

BACKGROUND OF THE INVENTION

Both professional and recreational golfers use their golf bags for many different purposes today. The bags are normally designed to carry clubs and balls, and accessories such as head covers, towels, hats, umbrellas, and golf tees. Many golf courses require that golfers walk the entire course and carry their own bags. Thus, the golfer is constantly placing the bag over his/her shoulders, removing the bag from their shoulders, and placing the bag down or standing-up the bag using a support leg mechanism on the bag. The golfer is also constantly removing and placing different clubs in the bag depending upon the shot being made. Thus, the golf bag needs to be durable, relatively lightweight, and comfortable to carry.

Many golf bags have a two strap system so the golfer can bear the weight of the bag on both shoulders. The first strap fits over a person's first shoulder and the second strap fits over the second shoulder. These dual straps tend to help improve the weight distribution of the bag and less weight stress is placed on each shoulder. The person carrying the bag tends to have better balance while walking with the bag because of this improved weight distribution.

However, two strap systems can have some drawbacks. For example, the golfer may easily place the first strap over the first shoulder, but then have difficulty finding and swinging the second strap over the second shoulder. The golfer may have to twist their back and arms at odd angles in order to swing the second shoulder strap over their second shoulder. This turning and twisting can lead to back and arm injuries. Additionally, once the two-strap system is mounted about the golfer's shoulders, a golfer can have difficulty keeping the bag distributed across the golfer's back sufficiently to maintain an even gate while progressing along the terrain of the course.

Thus, golf bag manufacturers continue to develop improved dual shoulder strap assemblies which better facilitate both mounting of the straps about the golfer's shoulders as well as achieving and maintaining excellent distribution of the bag's weight across the golfer's back on the course. Such improved golf bags, if meanwhile durable, possessing high mechanical strength, and producible cost effectively within existing golf bag manufacturing processes, would be particularly useful and desirable. The current golf bag of the invention addresses and solves these needs.

BRIEF DESCRIPTION OF THE DRAWINGS

The novel features that are characteristic of the present invention are set forth in the appended claims. However, the preferred embodiments of the invention, together with further objects and attendant advantages, are best understood by reference to the following detailed description in connection with the accompanying drawings in which like numerals refer to like elements of the inventive golf bag:

SUMMARY OF THE INVENTION

Figure 1A:
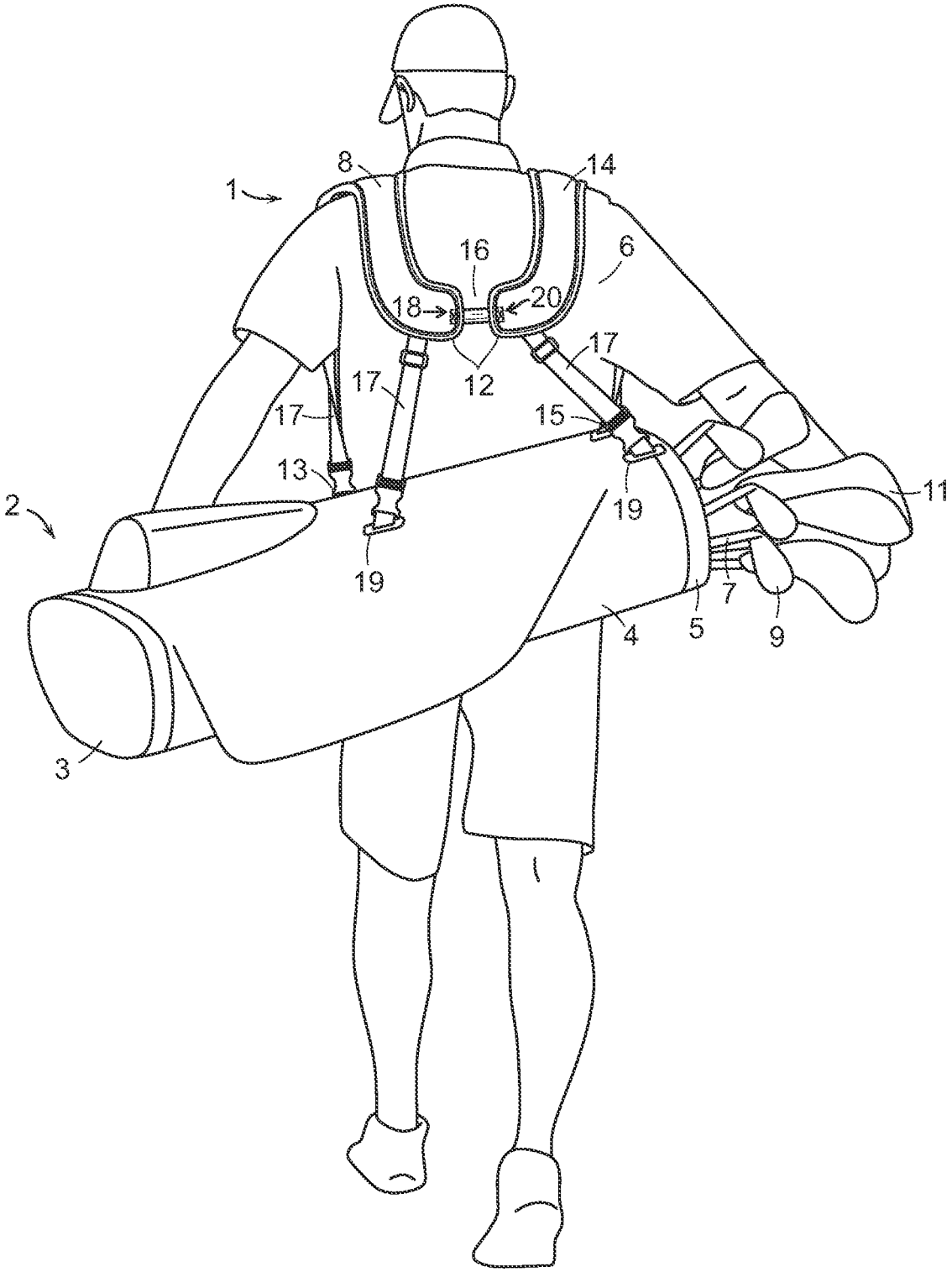
FIG. 1A is a rear perspective view of a person carrying a golf bag incorporating a dual shoulder strap assembly according to one embodiment of the invention.

Accordingly, in one embodiment, a golf bag of the invention comprises an elongated tubular body for holding golf clubs; and a shoulder strap assembly comprising: (i) a first strap having a first end and a second end; (ii) a second strap having a first end and a second end; and (iii) a bridge member having a first end and a second end. The first bridge member is disposed undetachably between the second end of the first strap and the second end of the second strap. Meanwhile, the elongated tubular body is configured to be detachably adjoined to each of the first end of the first strap, the first end of the second strap, the second end of the first strap and the second end of the second strap.

In one embodiment, the first strap comprises a first sheath, a first support member, and a first gripping layer; and the second strap comprises a second sheath, a second support member, and a second gripping member; wherein each sheath has a length $L_s$; each support member has a length $L_{su}$; and each gripping member has a length $L_g$; wherein $L_g<L_{su}<L_s$ such that each of the first strap and the second strap has a predetermined radius $R_p$.

In one embodiment, the bridge member, the first strap and the second strap are vertically coupled to form the shoulder strap assembly. In another embodiment, the bridge member, the first strap and the second strap are coupled horizontally to form the shoulder strap assembly.

In one embodiment, the bridge member comprises a flexible material.

In one embodiment, the first strap and the second strap are each flexibly adjoined to the elongated tubular body; and the first strap is flexibly adjoined to the second strap.

In one particular embodiment, the shoulder strap assembly is configured such that the second strap has a shape that is a reflection of the first strap's shape. In another embodiment, the first strap has a shape that differs from a shape of the second strap.

In one embodiment, at least one of the first strap sheath and the second strap sheath has an underside that contains surface texturing therein in a predetermined pattern that is configured to grip any surface that contacts the underside. In a specific such embodiment, the surface texturing is rubber-based.

In one embodiment, a golf bag of the invention comprises an elongated tubular body for holding golf clubs and a shoulder strap assembly comprising first and second straps; wherein a first section of each strap is configured to be adjacent a front of a wearer; a second section of each strap is configured to be adjacent a shoulder of the wearer; and a third section is configured to be adjacent to the wearer's back; and wherein the third section has a curve such that an upper portion of the third section extends vertically with respect to the wearer and a lower portion of the third section is horizontal with respect to the wearer.

A golf bag of the invention may comprise an elongated tubular body for holding golf clubs and a shoulder strap assembly, wherein the shoulder strap assembly comprises first and second straps; each strap having (i) a concave radius $r_{cc}$ extending from a first end of the strap to approximate a second end of the strap; and (ii) a convex radius $r_{ev}$ at the second end of the strap; wherein $r_{cc}>r_{ev}$.

DETAILED DESCRIPTION OF THE INVENTION

Figure 1B:
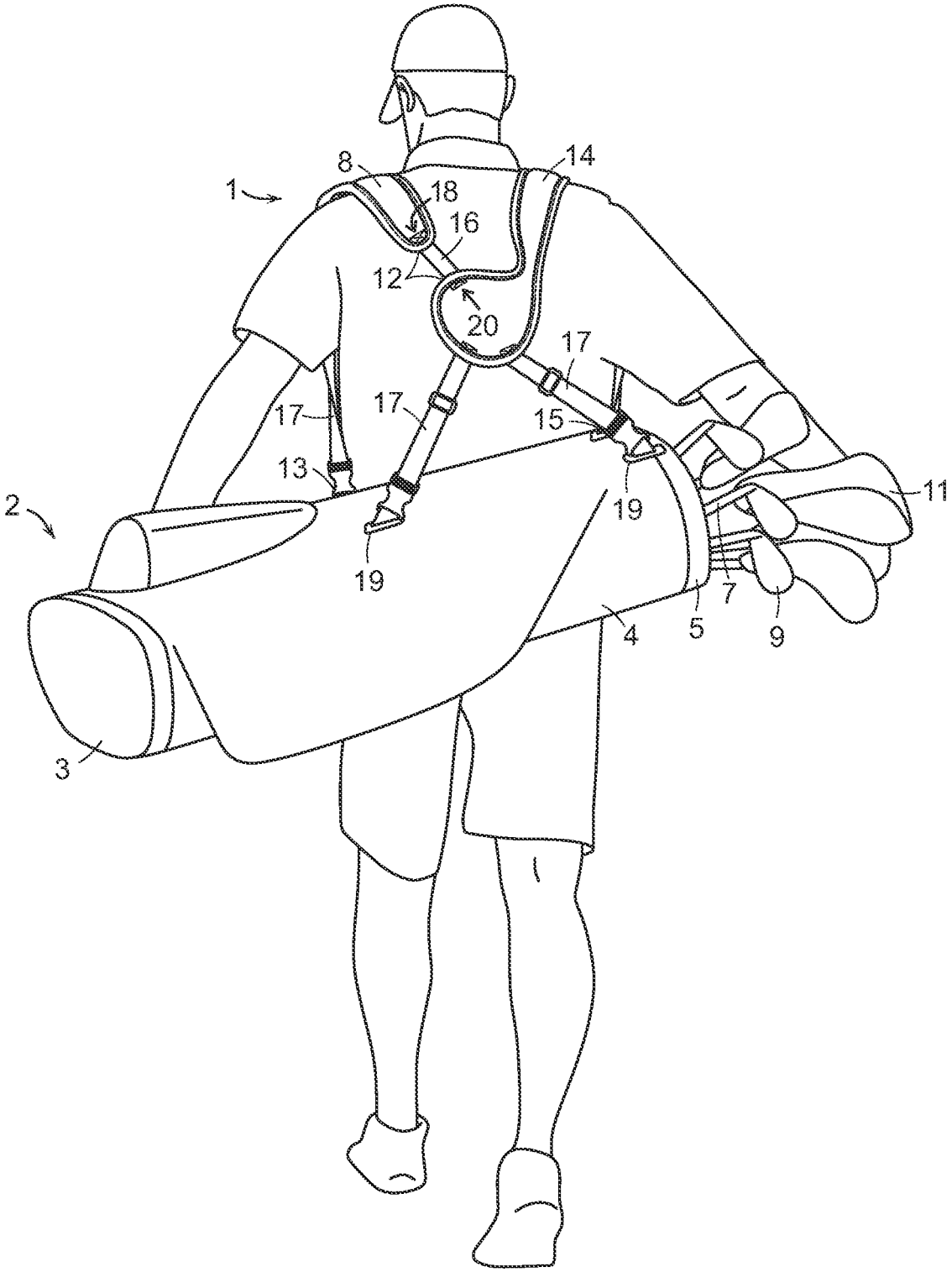
FIG. 1B is a rear perspective view of a person carrying a golf bag incorporating a dual shoulder strap assembly according to another embodiment of the invention.
Figure 1C:
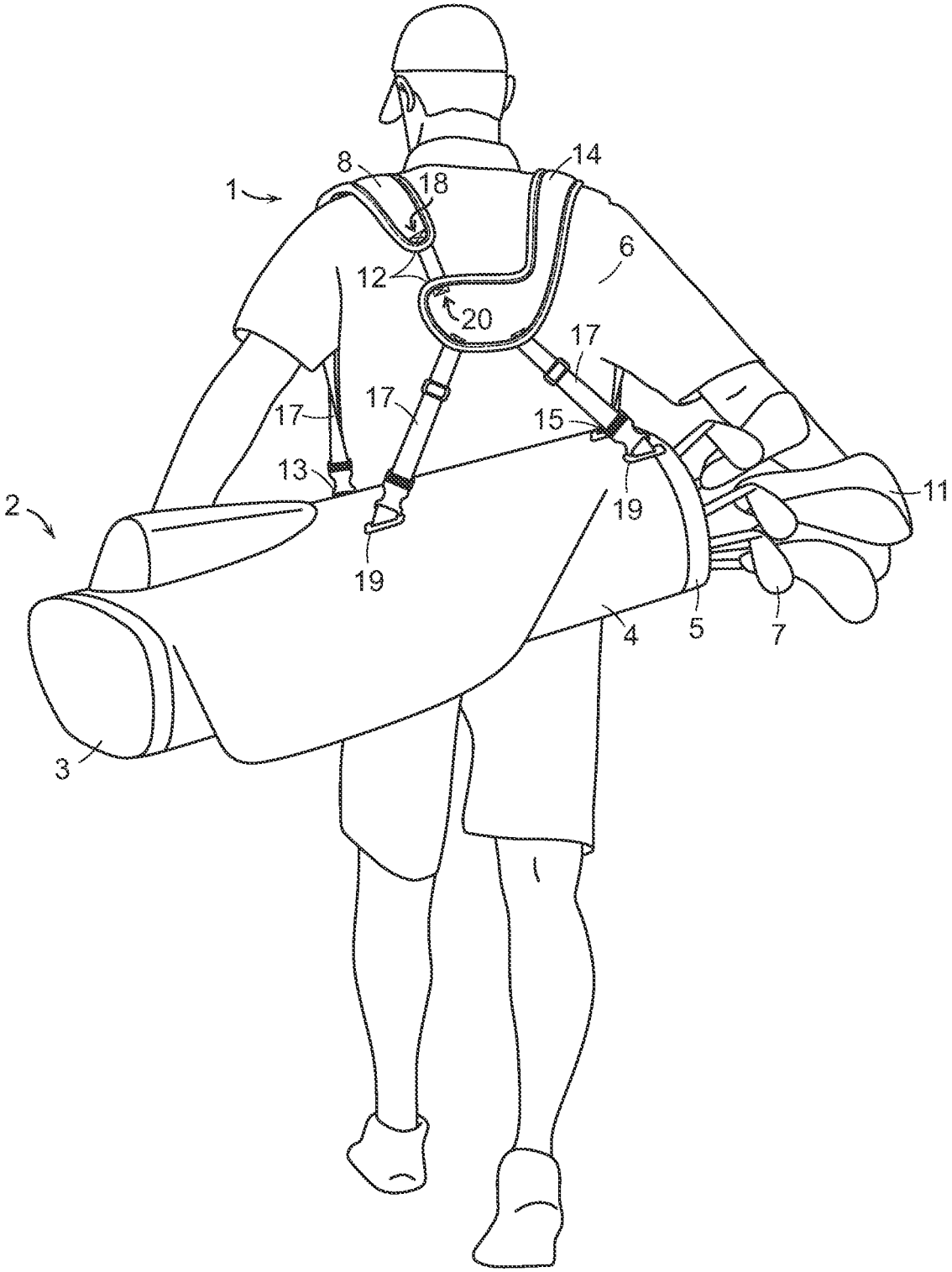
FIG. 1C is a rear perspective view of a person carrying a golf bag incorporating a dual shoulder strap assembly according to yet another embodiment of the invention.
Figure 1D:
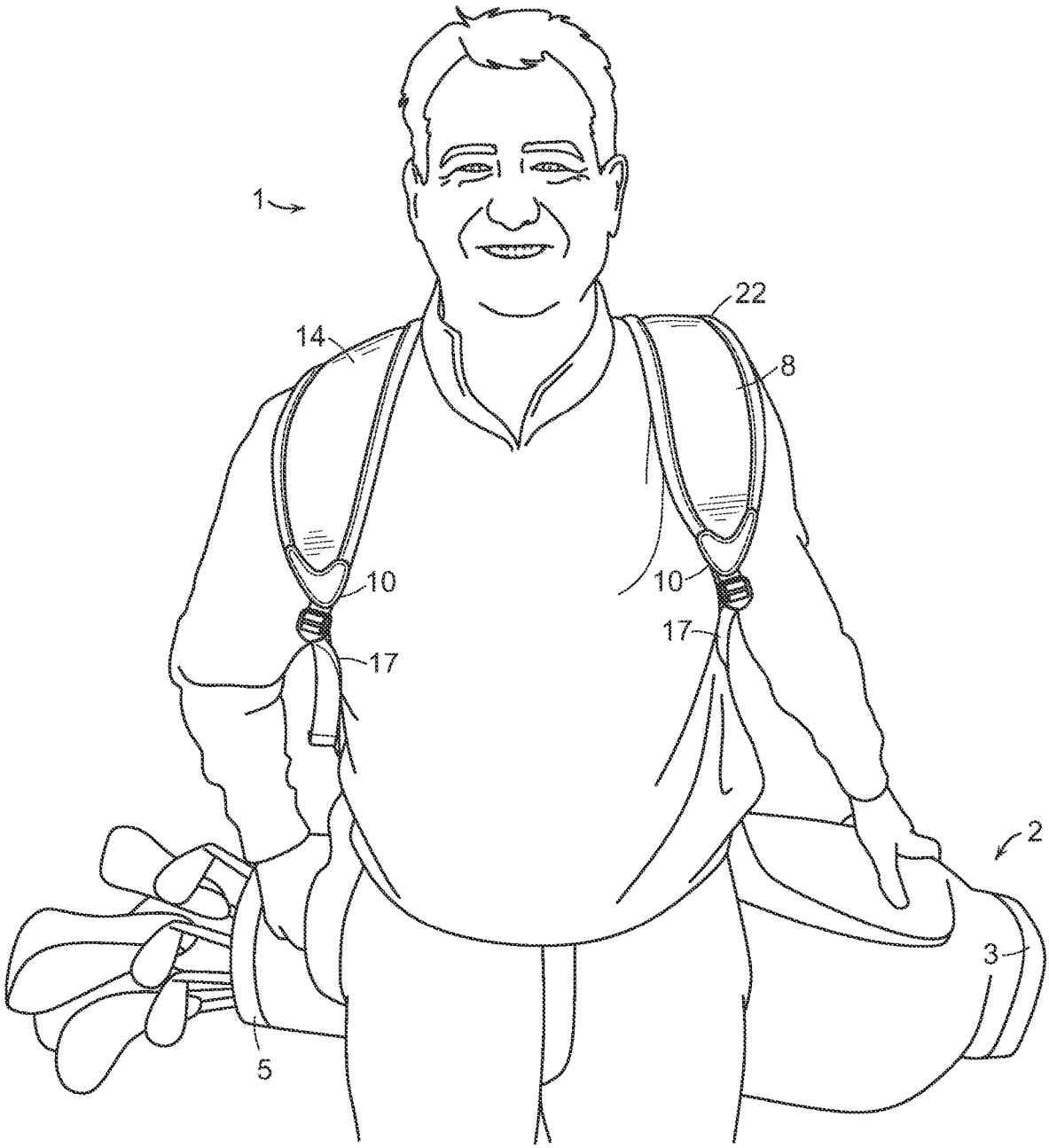
FIG. 1D is a front perspective view of a person carrying a golf bag incorporating a dual shoulder strap assembly according to any of the embodiments depicted in FIG. 1A, FIG. 1B or FIG. 1C.

Advantageously, a golf bag of the invention includes a dual shoulder strap assembly which enables and facilitates mounting of both straps about the golfer's shoulders as well as improves continued distribution of the bag's weight across the golfer's back on the course and is meanwhile durable, possesses high mechanical strength, and is producible cost effectively within existing golf bag manufacturing processes. Collectively, FIG. 1A, FIG. 1B, and FIG. 1C depict rear perspective views of a person carrying a golf bag incorporating a dual shoulder strap assembly according to three different constructions, and FIG. 1D depicts a frontal perspective views thereof. Golfer 1 carries golf bag 2 which comprises elongated tubular body 4 for holding golf clubs; as well as a dual shoulder strap assembly 6 that includes (i) a first strap 8, having a first end 10 and a second end 12; (ii) a second strap 14, having a first end 10 and a second end 12; and (iii) a bridge member 16 having a first end 18 and a second end 20.

Elongated tubular body 4 of golf bag 2 has a closed end 3 and an opposing open end 5, into which golf clubs 7 can be inserted into open end 5 of tubular body 4 (which has a cavity that is bordered by side walls (not shown)) of golf bag 2 such that, usually, golf club heads 9 with head covers 11 project from open end 5. The sidewall forming the cavity (not shown) within elongated tubular body 4 may include pockets and rings, and other compartments for golf balls, and accessories such as towels, hats, gloves, golf tees, beverages, and the like.

Elongated tubular body 4 can be made of any suitable textile material including leather, and woven/non-woven fabrics. Also, golf bag 2 may include a carrying handle and support leg assembly. The same or different fabric materials can be used to construct the elongated tubular body 4, such as lightweight, high-strength fabrics and/or plastics. For example, woven fabrics made of nylon, polypropylene, or polyester, can be used. Elastic webbing made of spandex or rubber fabric material also can be used. The webbing normally is relatively thin and has minimal or no padding. Plastic, metal, composite, or other suitable material may be used as well.

Figure 2A:
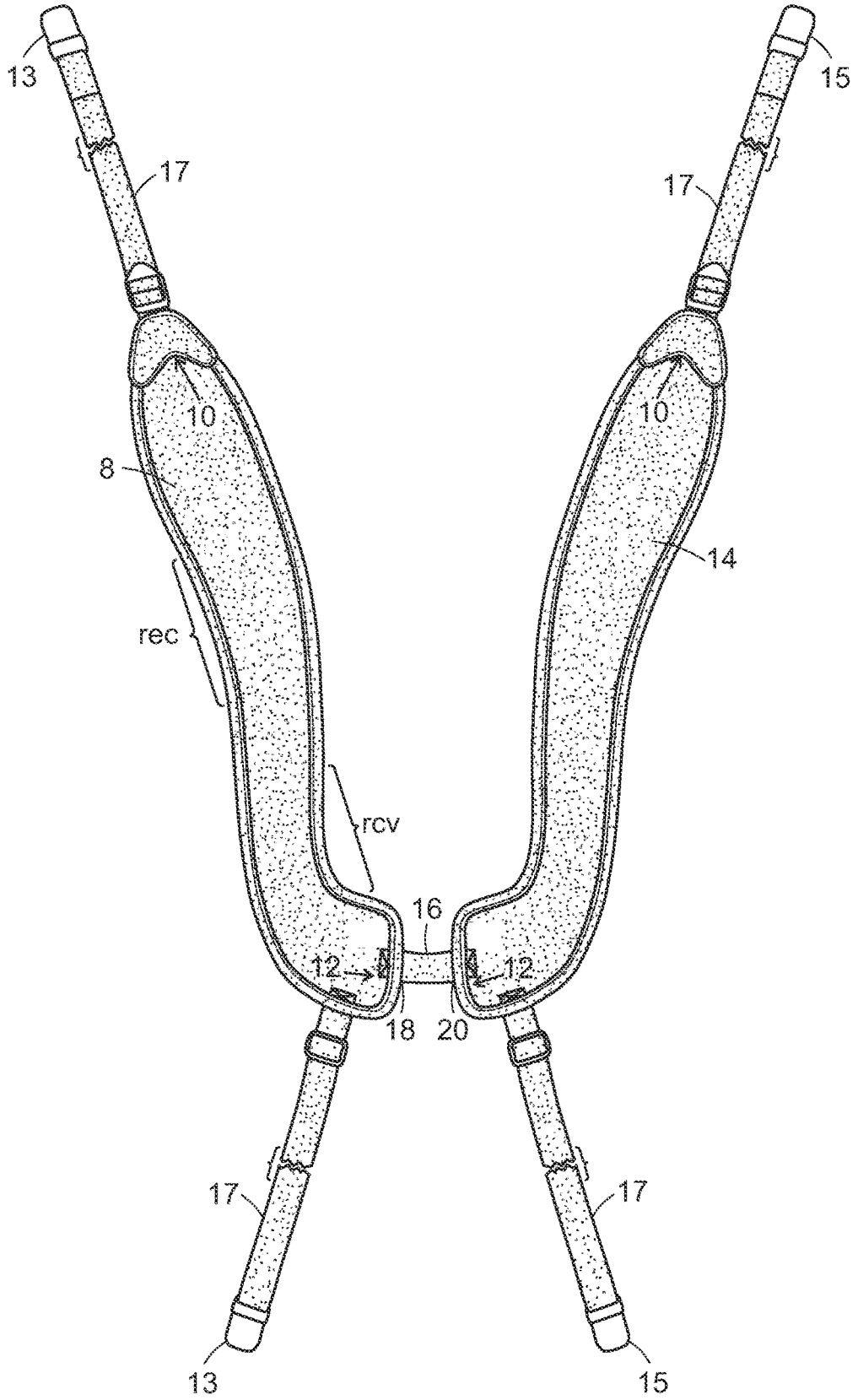
FIG. 2A is a close-up view of the dual shoulder strap assembly depicted in FIG. 1A.
Figure 2B:
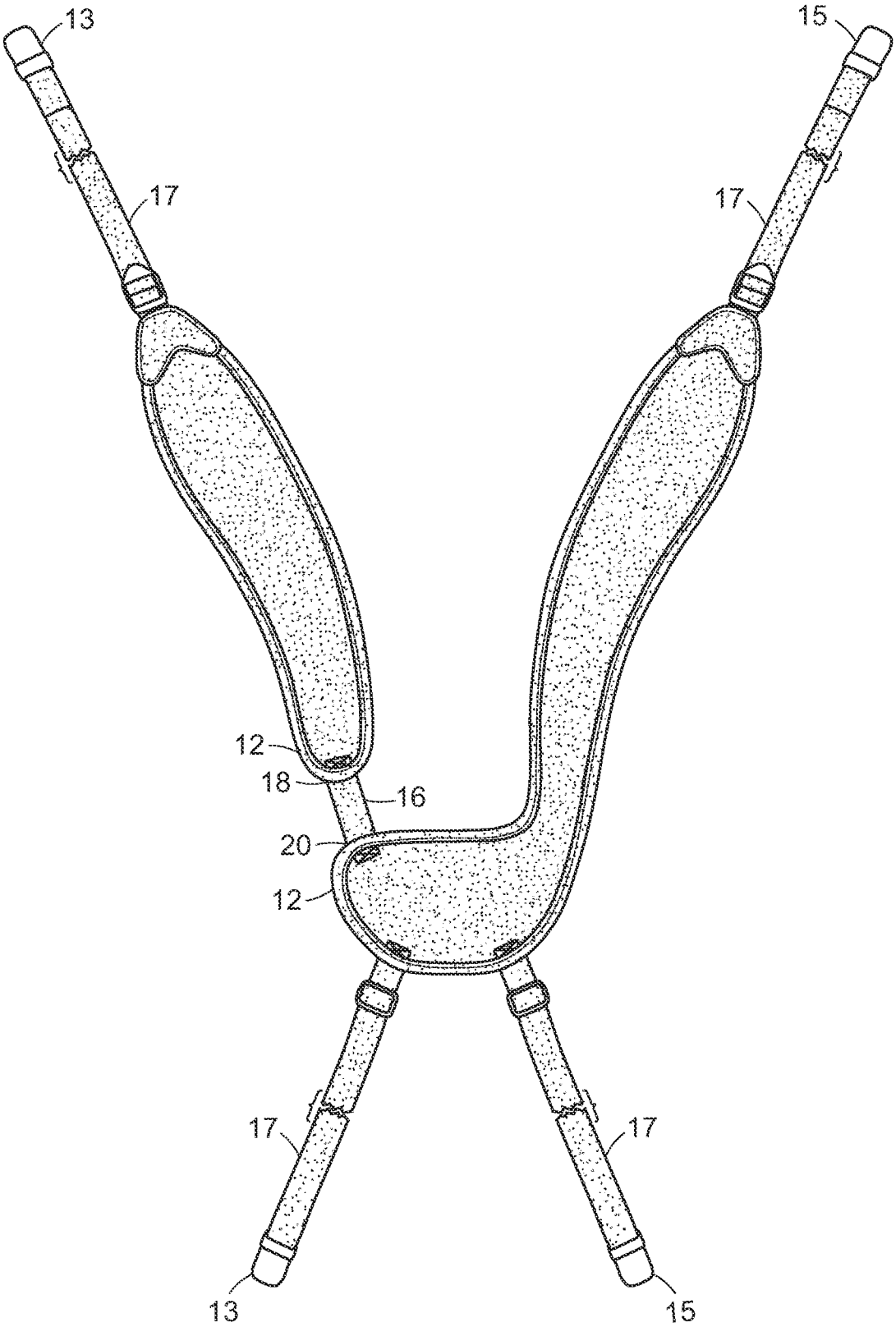
FIG. 2B is a close-up view of the dual shoulder strap assembly depicted in FIG. 1B.
Figure 2C:
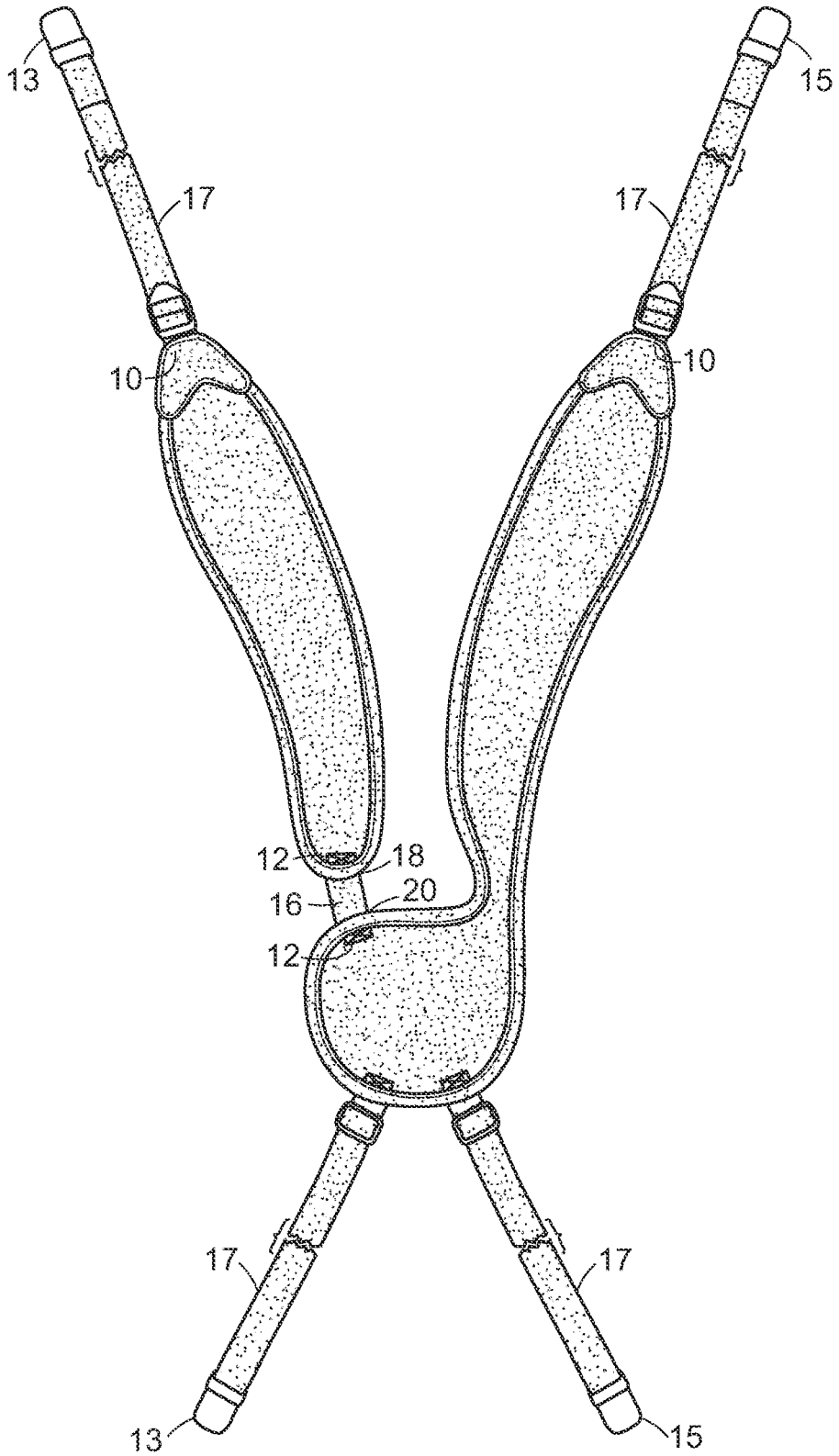
FIG. 2C is a close-up view of the dual shoulder strap assembly depicted in FIG. 1C.

In turn, FIG. 2A, FIG. 2B, and FIG. 2C are enlarged/close-up views of the dual shoulder strap assemblies 6 depicted collectively in FIG. 1A, FIG. 1B, FIG. 1C, and FIG. 1D respectively.

In each of these figures, bridge member 16 is disposed between and connecting the second ends 12 of first strap 8 and second strap 14 undetachably/unremovably/fixedly. Bridge member 16 is preferably formed from fabrics and/or compositions that are entirely or at least partially flexible, expandable, stretchable or otherwise pliable such as spandex or a rubber-containing fabric material. However, it is also envisioned that non-flexible fabrics and/or compositions may also be suitable materials for bridge member 16 such as an undetachable, non-removably attached plastic.

Meanwhile, elongated tubular body 4 of FIG. 1A, FIG. 1B, FIG. 1C and FIG. 1D is configured to be detachably adjoined/connected to first ends 10 and second ends 12 of each of first strap 8 and second strap 14 at connection mechanisms 13 and 15, respectively.

It is envisioned that first ends 10 and second ends 12 may be adjoined to elongated tubular body 4 either directly, or alternatively, indirectly by, for example, connecting straps 17 which are preferably undetachably/unremovably/fixedly attached to/adjoined with/to first ends 10 and second ends 12 yet detachably/removably attached/tethered to/adjoined with elongated tubular body 4 via attaching mechanisms 19 such as but not limited to sliders or other buckles, clips, clasps, hubs, pivots, eyehooks, loops, ties/knots, tri-glide clip, slide piece, or adjusting member that allows the shoulder strap to be adjusted lengthwise. Connecting straps 17 preferably have adjustable lengths.

In some embodiments, in lieu of attaching mechanisms 19, a bridge member such as bridge member 16 may be used to adjoin first ends 10 and second ends 12 to elongated tubular body 4 undetachably at both ends of each of straps 17. Any suitably shaped/constructed flexible or non-flexible or at least partially flexible bridge member may be used to adjoin first ends 10 and second ends 12 to elongated tubular body 4.

Figure 3:
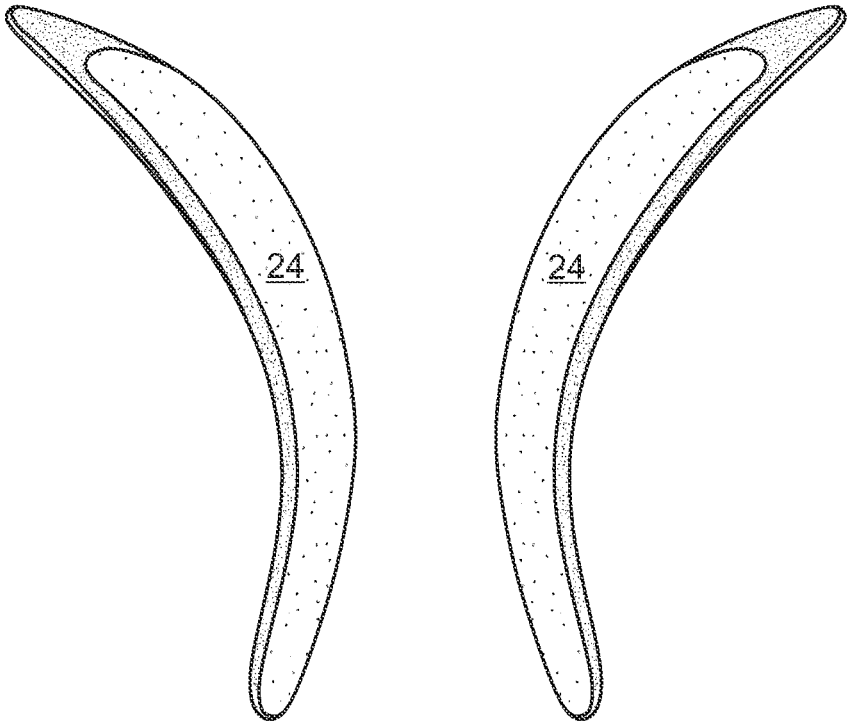
FIG. 3 is a close-up view of first and second support members having different lengths and being configured to be enclosed by a sheath according to one embodiment of the invention.
Figure 4:
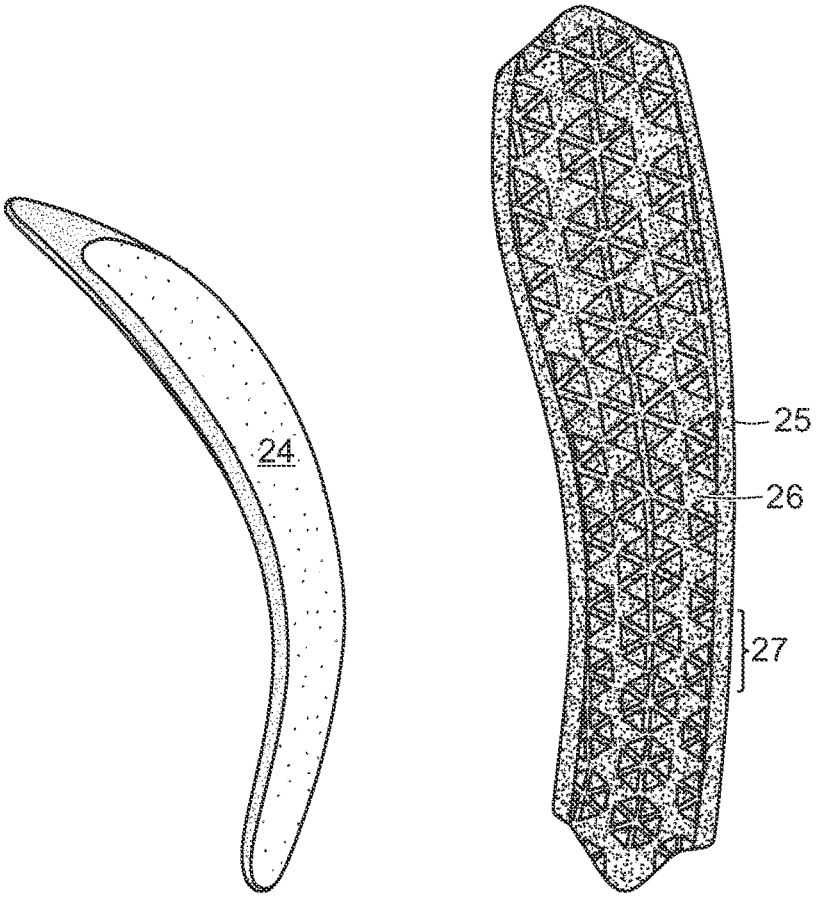
FIG. 4 is a close-up view of each of a support member and a gripping member that contains surface texturing in a predetermined pattern.
Figure 5:
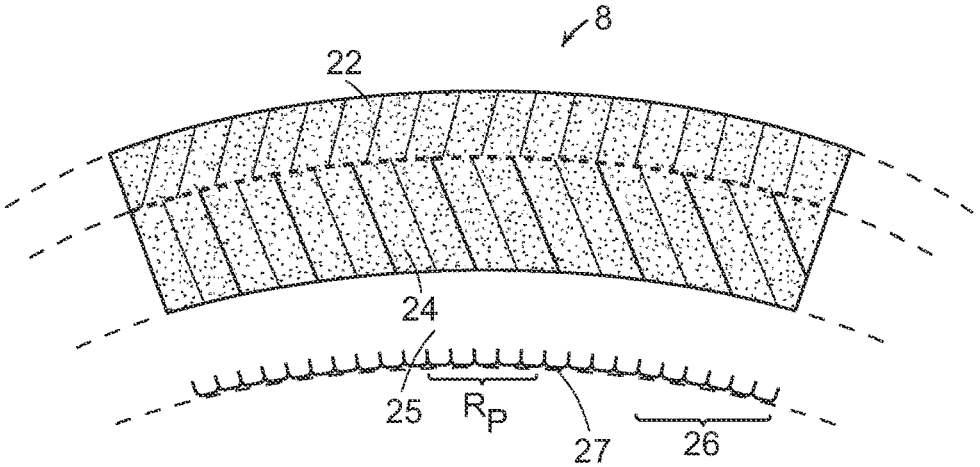
FIG. 5 is a cross-section of a shoulder strap construction according to one embodiment of the invention.

In one embodiment, as is represented in the cross-section of first strap 8 of FIG. 5, first strap 8 (as well as second strap 14, not shown) may be constructed so that sheath 22 is adjacent to support member 24 (illustrated in FIG. 3), which in turn is adjacent to gripping member 25 (having an underside with surface texturing 26 thereon in a predetermined pattern 27 such as also depicted in FIG. 4); wherein sheath 22 has a length $L_s$; support member 24 has a length $L_{su}$; and gripping member 25 has a length $L_g$; wherein $L_g<L_{su}<L_s$ such that each strap (first strap 8/second strap 14) has a predetermined radius $R_p$. This construction can facilitate and improve how a strap 8 conforms to the wearer's shoulder. In a specific embodiment, surface texturing 26 in a predetermined pattern 27 may be formed of a rubber-based material.

In another embodiment, each strap comprises a sheath that encloses a support member which has a contour that is configured to be enclosed by the sheath. In this embodiment, the support member(s) are preferably flexible, curved, lightweight and relatively flat when not flexed or otherwise bent.

In one embodiment, bridge member 16, first strap 8 and the second strap 14 are coupled horizontally within shoulder strap assembly 6 such as in FIG. 1A. In another embodiment, bridge member 16, first strap 8 and second strap 14 are coupled vertically within shoulder strap assembly 6 such as in FIG. 1B and FIG. 1C. Other constructions are likewise envisioned, for example, wherein bridge member 16, first strap 8 and second strap 14 are coupled diagonally within shoulder strap assembly 6.

As used herein, the phrase "coupled vertically" means that the intersection of the first end 18 (of bridge member 16) and the second end 12 (of first strap 8) is vertically aligned with the intersection of the second end 20 (of bridge member 16) and the second end 12 (of second strap 14). Meanwhile, as used herein, the phrase "coupled horizontally" means that the intersection of the first end 18 (of bridge member 16) and the second end 12 (of first strap 8) is horizontally aligned with the intersection of the second end 20 (of bridge member 16) and the second end 12 (of second strap 14).

In one embodiment, first strap 8 and second strap 14 are each flexibly adjoined to elongated tubular body 4; and first strap 8 is flexibly adjoined to second strap 14.

In one particular embodiment, shoulder strap assembly 6 is configured such that second strap 14 has a shape that is a reflection of the shape of first strap 8. In another particular embodiment, shoulder strap assembly 6 is configured such that second strap 14 has a shape that is a partial reflection of the shape of first strap 8.

In yet another embodiment, shoulder strap assembly 6 is configured such that second strap 14 has a shape that is a translation of the shape of first strap 8. In still another embodiment, shoulder strap assembly 6 is configured such that second strap 14 has a shape that is a partial translation of the shape of first strap 8.

In alternative embodiments, first strap 8 has a shape that differs partially or in its entirety from the shape of second strap 14.

In particular embodiments, first strap 8 is shorter than second strap 14, which can facilitate a golfer's mounting and/or dismounting of the golf bag assembly by permitting one or more ends of first strap 8 to be released/disconnected from elongated body 4 before releasing one or more ends of second strap 14 so that the golf bag assembly can be slidably removed perhaps without even disconnecting second strap 14 from elongated body 4.

In one particular embodiment of a golf bag of the invention, shoulder strap assembly 6 comprises first strap 8 and second strap 14; wherein a first section of each strap is configured to be adjacent the wearer's front or chest area; a second section of each strap is configured to be adjacent or rest upon a shoulder of the wearer; and a third section of each strap is configured to be adjacent wearer's back; and wherein third section has a curve such that an upper portion of the third section extends vertically with respect to both the strap assembly and the wearer and a lower portion of the third section extends horizontally with respect to both the strap assembly and the wearer. It is envisioned that the lengths of each of the first, second and third sections can be pre-selected and coordinated considering torso measurement ranges for wearers or be customized according to match a particular wearer's torso measurements.

As emphasized on first strap 8 in FIG. 2A, first strap 8 and second strap 14 may each have (i) a concave radius $r_{cc}$ extending from first end 10 to approximate a second end 12; and (ii) a convex radius $r_{ev}$ at second end 12; wherein $r_{cc}>r_{ev}$.

It is envisioned that any of the constructions/shaped/contours of first strap 8 and second strap 14 discussed herein may be reversed, which may be of particular use for example when considering whether a person is left-handed or right-handed.

Any portion of shoulder straps 8 and 14 can have a cushioned portion made of any suitable material including, but not limited to, foams, natural and synthetic leathers, natural and synthetic rubbers, woven and non-woven materials, and natural and synthetic fabrics. Foamed materials are particularly preferred for constructing the cushioned portions. These foamed materials have good stability and yet are also sufficiently flexible to make the cushioned portions comfortable when resting on the shoulders. These foamed materials can have a relatively soft durometer, for example, the hardness can be in the range of about 10 to about 80 Shore A. Another hardness scale (Asker®C) can be used to measure the indentation hardness of the foams, soft rubbers, elastomers or other materials, and the Asker C hardness is normally in the range of 25 to 75.

In general, foam compositions are made by forming gas bubbles in a polymer mixture using a foaming (blowing) agent. As the bubbles form, the mixture expands and forms a foam composition having either an open or closed cellular structure. Many foams contain both open and closed cells. Various thermoplastic and thermoset materials may be used in forming the foam compositions as discussed further below. In one preferred embodiment, a polyurethane foam composition is used to form the foam material. In another embodiment, ethylene vinyl acetate (EVA) foams are used. In a particularly preferred embodiment, a high-stretch, high-recovery foam material referred to as AriaPrene™, and available from Tiong Long Corp. can be used. This foam material is hypo-allergenic, lightweight, non-toxic, and decomposable.

Other thermoplastic elastomers that can be used in accordance with this invention include polyester-polyether block copolymers such as Hytrel® resins, available from DuPont. These block copolymers are available in different grades and contain hard (crystalline) segments of polybutylene terephthalate and soft (amorphous) segments based on long-chain polyether glycols. Polyether-amide block copolymers, which are commonly known as Pebax® resins, and are available from Arkema, Inc. (Columbs, France), also may be used. Other suitable thermoplastic polymers include, but are not limited to, polyurethanes, polyureas, silicones, ethylene acid copolymer ionomers, polyesters, polyolefins, polyamides, polyamide-ethers, polyamide-esters; fluoropolymers, polystyrenes, polyvinyl chlorides, polycarbonates, polyethers, and polyimides including homopolymers, copolymers, and modified polymers and blends thereof.

Natural and synthetic rubber materials also may be used. Suitable rubber materials include, but are not limited to, polybutadiene, polyisoprene, ethylene propylene rubber ("EPR"), ethylene-propylene-diene ("EPDM") rubber, styrene-butadiene rubber, styrenic block copolymer rubbers (such as "SI", "SIS", "SB", "SBS", "SIBS", "SEBS", "SEPS" and the like, where "S" is styrene, "I" is isobutylene, "E" is ethylene, "P" is propylene, and "B" is butadiene), polyalkenamers such as, for example, polyoctenamer, butyl rubber, halobutyl rubber, polystyrene elastomers, polyethylene elastomers, polyurethane elastomers, polyurea elastomers, metallocene-catalyzed elastomers and plastomers, copolymers of isobutylene and p-alkylstyrene, halogenated copolymers of isobutylene and p-alkylstyrene, copolymers of butadiene with acrylonitrile, polychloroprene, alkyl acrylate rubber, chlorinated isoprene rubber, acrylonitrile chlorinated isoprene rubber, and blends of two or more thereof.

When numerical lower limits and numerical upper limits are set forth herein, it is contemplated that any combination of these values may be used. Other than in the operating examples, or unless otherwise expressly specified, all of the numerical ranges, amounts, values and percentages such as those for amounts of materials and others in the specification may be read as if prefaced by the word "about" even though the term "about" may not expressly appear with the value, amount or range. Accordingly, unless indicated to the contrary, the numerical parameters set forth in the specification and attached claims are approximations that may vary depending upon the desired properties sought to be obtained by the present invention.

All patents, publications, test procedures, and other references cited herein, including priority documents, are fully incorporated by reference to the extent such disclosure is not inconsistent with this invention and for all jurisdictions in which such incorporation is permitted. It is understood that the structures and products described and illustrated herein represent only some embodiments of the invention. It is appreciated by those skilled in the art that various changes and additions can be made to the presently disclosed structures and products without departing from the spirit and scope of this invention. It is intended that all such embodiments be covered by the appended claims.

What is claimed is:

1. A golf bag, comprising:

a body for holding one or more golf clubs; and a shoulder strap assembly comprising (i) a first shoulder strap having a first end and a second end, (ii) a second shoulder strap having a first end and a second end, (iii) a bridge member having a first end and a second end, and (iv) a plurality of connecting straps coupled to the first shoulder strap and the second shoulder strap, wherein the second end of the first shoulder strap and the second end of the second shoulder strap are configured to extend laterally towards each other, wherein the bridge member is fixed between the second end of the first shoulder strap and the second end of the second shoulder strap to directly couple the first and second shoulder straps such that the first shoulder strap and the second shoulder strap are undetachable relative to each other, wherein the plurality of connecting straps are configured to directly and detachably adjoin the body to the first end of the first shoulder strap, the first end of the second shoulder strap, and at least one of (a) the second end of the first shoulder strap and (b) the second end of the second shoulder strap, wherein the first end of the bridge member is attached to the first shoulder strap at a first attachment point, wherein the second end of the bridge member is attached to the second shoulder strap at a second attachment point, wherein the bridge member spans a first distance between the first attachment point and the second attachment point, and wherein the plurality of connecting straps are attached to the first shoulder strap and the second shoulder strap at a third attachment point and a fourth attachment point, wherein the third and fourth attachment points are spaced apart at a second distance that is greater than the first distance.

2. The golf bag of claim 1, wherein the bridge member comprises a flexible material or an elastic material.

3. The golf bag of claim 1, wherein the bridge member comprises a different material than (i) the plurality of connecting straps or (ii) the first or second shoulder straps.

4. The golf bag of claim 1, wherein the bridge member is configured to extend horizontally between the first shoulder strap and the second shoulder strap.

5. The golf bag of claim 1, wherein the bridge member is configured to extend vertically between the first shoulder strap and the second shoulder strap.

6. The golf bag of claim 1, wherein the bridge member is configured to extend diagonally between the first shoulder strap and the second shoulder strap.

7. The golf bag of claim 1, wherein the first shoulder strap has a first shape and the second shoulder strap has a second shape that is a reflection of the first shape.

8. The golf bag of claim 1, wherein the first shoulder strap has a first shape and the second shoulder strap has a second shape that is different than the first shape.

9. The golf bag of claim 1, wherein the first shoulder strap and the second shoulder strap have different lengths.

10. The golf bag of claim 1, wherein the first shoulder strap and the second shoulder strap each comprise a first curvature and a second curvature.

11. The golf bag of claim 10, wherein the first curvature of the first shoulder strap and the first curvature of the second shoulder strap are oriented towards each other.

12. The golf bag of claim 10, wherein the second curvature of the first shoulder strap and the second curvature of the second shoulder strap are oriented away from each other.

13. The golf bag of claim 10, wherein the first curvature has a first radius of curvature and the second curvature has a second radius of curvature that is greater than the first radius of curvature.

14. The golf bag of claim 1, wherein the second end of the first shoulder strap and the second end of the second shoulder strap each comprise a horizontal extension to which the bridge member is attached.

15. The golf bag of claim 14, wherein the horizontal extension comprises an upper portion formed by a first curvature of the first or second shoulder strap and a lower portion formed by a second curvature of the first or second shoulder strap.

16. The golf bag of claim 15, wherein the horizontal extension further comprises a medial portion positioned between the upper portion and the lower portion of the horizontal extension.

17. The golf bag of claim 16, wherein the bridge member is fixed to a substantially vertical segment of the medial portion of the horizontal extension, and wherein at least one of the plurality of connecting straps is fixed to the lower portion of the horizontal extension.

18. The golf bag of claim 1, wherein the first and second shoulder straps each comprise (i) a cushioned portion comprising a foam material and (ii) a textured portion comprising a natural or synthetic rubber.

19. The golf bag of claim 18, wherein the foam material has a hardness ranging from about 10 Shore A to about 80 Shore A.

20. The golf bag of claim 18, wherein the textured portion comprises a triangular or hexagonal pattern.

* * * * *